United States Patent [19]

Laven

[11] 4,048,773

[45] Sept. 20, 1977

[54] ABOVE-GROUND POOL WALLS, PANELS THEREFOR, AND PANEL-MANUFACTURING METHODS

[76] Inventor: Merrill L. Laven, 4 Marion Ave., Albany, N.Y. 12203

[21] Appl. No.: 656,594

[22] Filed: Feb. 9, 1976

Related U.S. Application Data

[63] Continuation-in-part of Ser. No. 428,882, Dec. 27, 1973, Pat. No. 3,938,199.

[51] Int. Cl.[2] ..... E04H 3/16

[52] U.S. Cl. ..... 52/169.7; 4/172.19; 52/249; 52/586

[58] Field of Search ..... 4/172.19; 52/585, 586, 52/169, 249, 169.7; 220/5 A

[56] References Cited

U.S. PATENT DOCUMENTS

| | | | |
|---|---|---|---|
| 2,861,277 | 11/1958 | Hermann | 4/172.19 |
| 3,015,191 | 2/1962 | Lucchesi | 52/169 |
| 3,564,791 | 2/1971 | Arp | 52/169 |
| 3,759,003 | 9/1973 | Wilson | 52/585 X |
| 3,819,079 | 6/1974 | Levens | 4/172.19 X |

*Primary Examiner*—Alfred C. Perham
*Attorney, Agent, or Firm*—Steinberg & Blake

[57] ABSTRACT

An above-ground pool has a pool wall made up of a series of upright, adjoining wall panels situated in end-to-end relation along an endless path so that the panels surround a given space in which water for the pool may be located. A plurality of upright rods are situated between the adjoining panels. Each panel has opposed upright end edge regions, and at each end edge region each panel has a plurality of substantially rigid fastener portions distributed along each end edge region. These fastener portions include inner fastener portions and outer fastener portions which alternate in elevation with the inner fastener portions along each end edge region of each panel. The outer fastener portions respectively have inwardly directed surfaces directed inwardly toward the interior of the pool and respectively formed with aligned grooves receiving part of a rod, while the outer fastener portions respectively have outwardly directed surfaces directed away from the interior of the pool and respectively formed with aligned grooves also receiving part of the rod. Thus, the rod at each end edge region of each panel can be situated in or removed from the grooves only by being displaced substantially vertically with respect to an upright wal panel. The inner fastener portions at an end edge region of one panel are respectively at the same elevations as the outer fastener portions at an end edge region of an adjoining panel, so that each rod extends through interlocked fastener portions at the end edge regions of adjoining panels. By way of this construction the panels are held together to form a continuous pool wall.

13 Claims, 8 Drawing Figures

ABOVE-GROUND POOL WALLS, PANELS THEREFOR, AND PANEL-MANUFACTURING METHODS

CROSS REFERENCE TO RELATED APPLICATION

This application is a continuation-in-part of copending application Ser. No. 428,882, filed Dec. 27, 1973 now U.S. Pat. No. 3,938,199.

BACKGROUND OF THE INVENTION

The present invention relates to swimming pools.

In particular, the present invention relates to above-ground swimming pools.

Swimming pools of this latter type are highly desirable since they can be set up on the ground usually at a lesser cost than below-ground swimming pools. However, because of the considerable force exerted against the wall of an above-ground pool by the water therein, conventional above-ground pools are relatively complex in that they require extremely strong complicated outer frame works to give to the wall of the pool the required strength. In addition, the sections of the pool wall must be connected one to the next in a very special way so as to prevent the sections from being forced apart from each other by the pressure of the water in the pool. Because of these factors conventional above-ground pools have the disadvantages of being relatively expensive and difficult to set up while at the same time occupying an undersirably large amount of space outwardly beyond the interior of the pool itself.

SUMMARY OF THE INVENTION

It is accordingly a primary object of the present invention to provide an above-ground pool which will avoid the above drawbacks. In particular, it is an object of the present invention to provide an above-ground pool having a pool wall composed of relatively simple, light-weight panels which are interconnected one with the next in a simple manner while at the same time assuring for the pool of the invention the required strength and reliability of interconnection between adjoining wall panels.

A further object of the invention is to provide an above-ground pool which not only is relatively simple and low in cost, but which also can be set up in a rapid convenient manner by relatively unskilled individuals such as the purchaser of the pool.

In particular, it is an object of the invention to provide an above-ground pool having a wall structure consisting only of a series of identical panels which can be reliably interconnected one with the next by a simple rod.

Also, it is an object of the present invention to provide for a pool wall panel which can be molded in one piece of a relatively light weight plastic which while having a small thickness nevertheless has the required strength, thus enabling relatively light-weight wall panels to be utilized for the pool of the invention.

Thus, the object of the present invention include not only the provision of an entire pool wall but also the provision of a panel to be used in a pool wall and a method for manufacturing such a panel.

According to the invention the above-ground pool has a plurality of upright adjoining wall panels situated one next to the other in end-to-end relation along a predetermined endless path so that the panels surround a given space in which water for the pool may be located. An upright rod is situated between the ends of adjoining panels. Each panel has opposed end edge regions each of which has a plurality of substantially rigid fastener portions distributed there-along. The fastener portions at each end edge region of each panel include inner fastener portions and outer fastener portions which respectively alternate in elevation with the inner fastener portions. The outer fastener portions respectively have inwardly directed surfaces directed toward the interior of the pool and respectively formed with aligned grooves which receive part of a rod, while the inner fastener portions have outwardly directed surfaces directed away from the interior of the pool and respectively formed with aligned grooves which also receive part of the rod. Thus the rod can be moved into or out of the grooves of the fastener portions at an end edge of a panel only by being displaced vertically with respect to an upright panel. The inner and outer fastener portions at an end edge region of one panel are respectively situated at the same elevations as the outer and inner fastener portions at the adjoining end edge region of an adjoining panel, and all of the inner fastener portions of adjoining end edge regions of adjoiningpanels are interdigitated while all of the outer fastener portions at adjoining end edge regions of adjoining panels are also interdigitated, so that by way of this construction each pair of adjoining panels are reliably interconnected by a rod in such a way that the several panels are held together to form a continuous pool wall.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
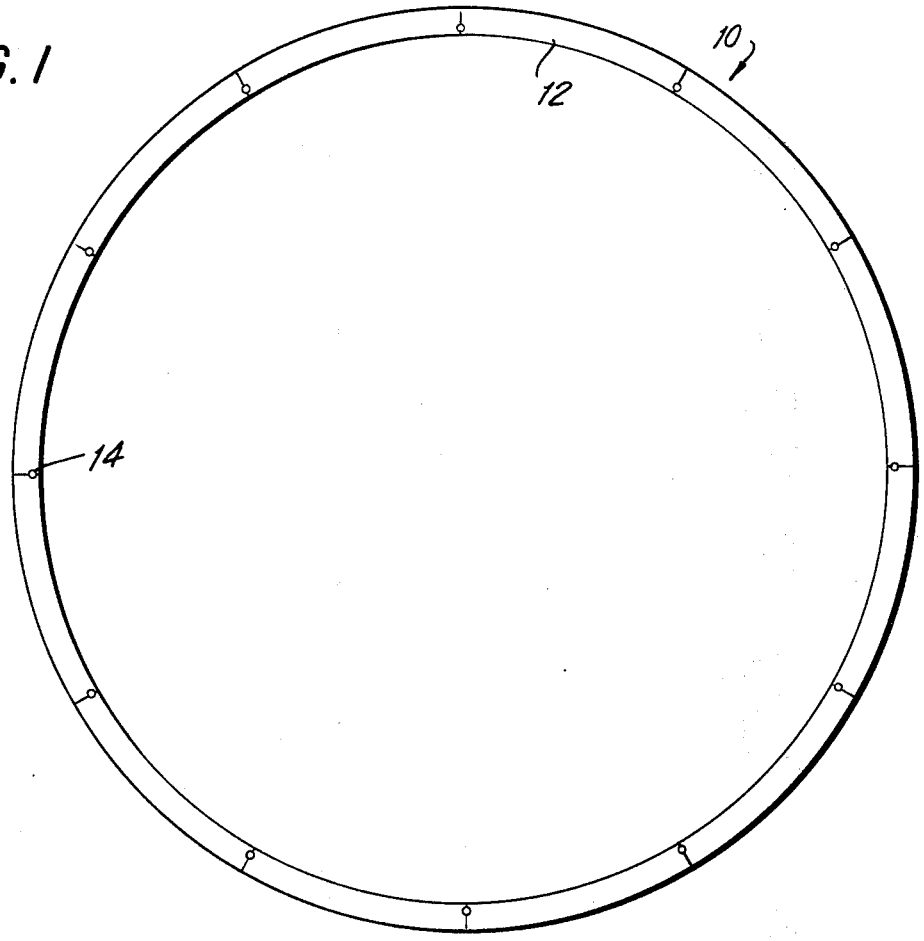
FIG. 1 is a schematic top plan view of a wall for an above-ground pool of the invention.

Referring to FIG. 1, there is schematically illustrated therein, in a top plan view, a circular pool wall structure 10 made up of a series of identical panels 12 situated one-next-to the other in end-to-end relation along the circular enless path illustrated in FIG. 1 and interconnected only by rods 14 in the manner described in greater detail below. The circular construction shown in FIG. 1 is preferred inasmuch as in this way all of the wall panels 12 can be identically constructed, thus reducing the manufacturing costs and simplifying the setting up of the pool. Moreover, with such a circular pool a very favorable distribution of forces is achieved. It is to be understood that FIG. 1 shows the pool of the invention in a simplified manner. In an actual above-ground pool of the invention, for example, each panel 12 will extend through an arc along a circle around a central vertical axis through approximately 24° so that 15 panels would be required for such a construction, and the inner radius of the pool could be on the order of 12 feet. Each panel could have a height on the order of 4 feet, for example.

Figure 2:
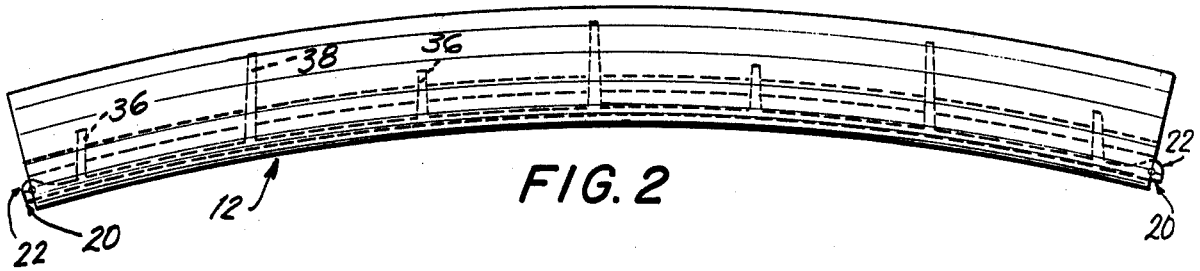
FIG. 2 is a top plan view of one of the wall panels of the wall of FIG. 1.
Figure 3:
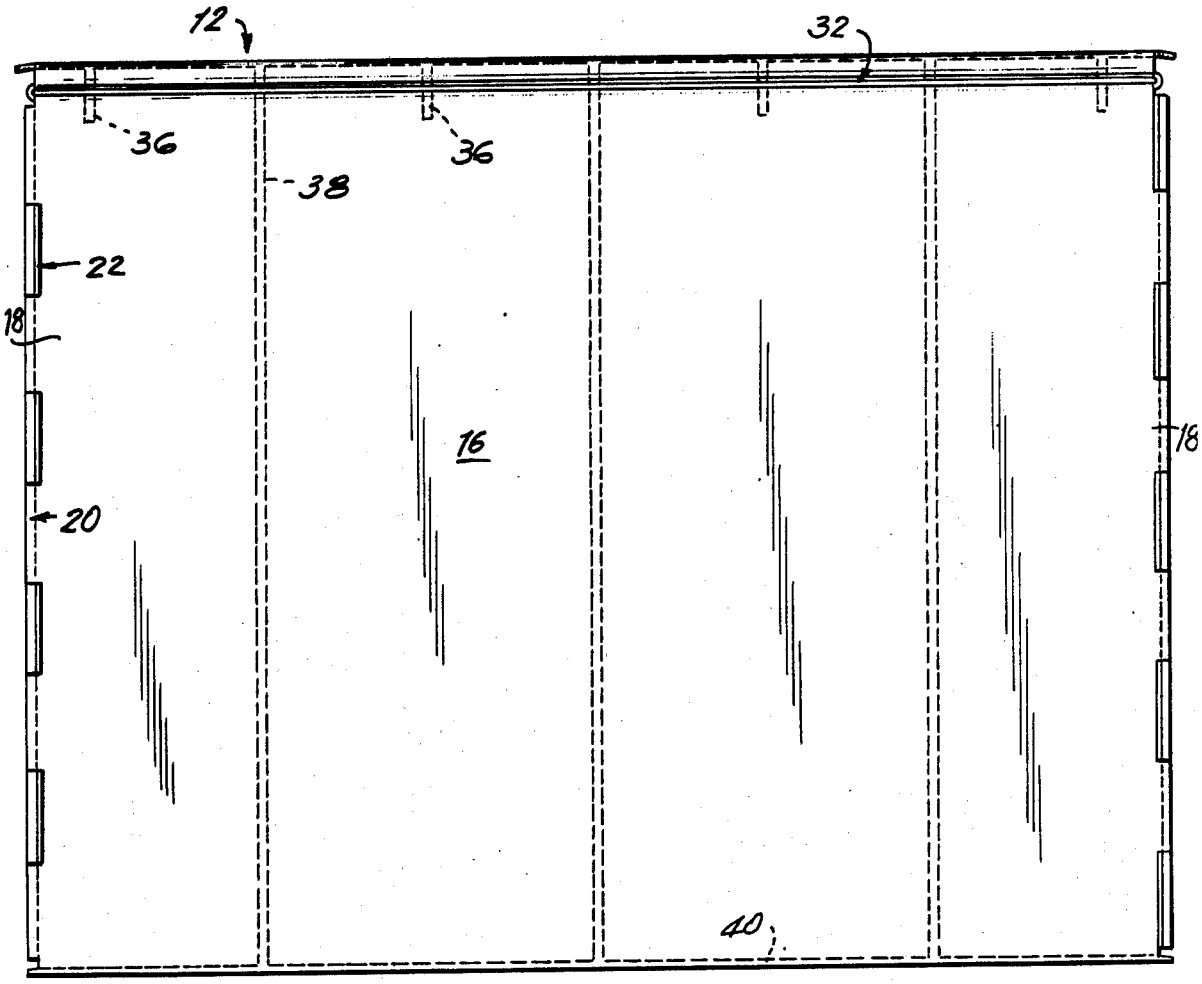
FIG. 3 is a front elevation of the panel of FIG. 2 as seen when looking toward the concave inner surface thereof.
Figure 4:
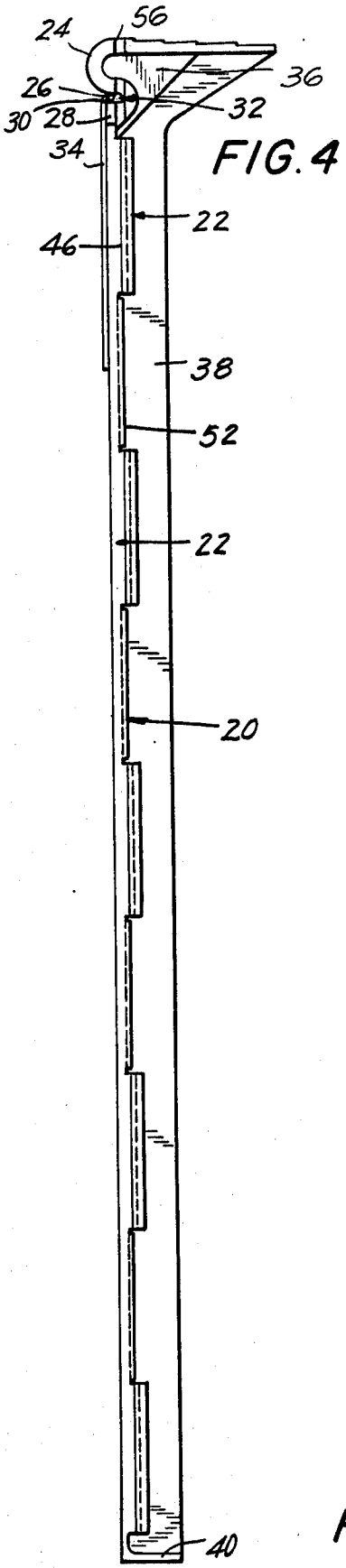
FIG. 4 is an end elevation of the panel of FIG. 3 as seen when looking toward the right end of FIG. 3.

Referring to FIGS. 2–4, it will be seen that each panel 12 has an inner concave surface 16 and opposed end edge regions 18 at each of which each panel has a plurality of substantially rigid fastener portions including inner fastener portions 20 and outer fastener portions 22 which alternate in elevation with the inner fastener portions 20 along each end edge region 18. These fastener portions 20 and 22 project slightly beyond the end sufaces of each panel, as is apparent from FIG. 2.

As is shown most clearly in FIG. 4, each panel has a relatively small thickness and is provided at its top end with an upper hollow coping portion 24 beneath which each panel is suitably shaped to form a stepped recess 26 adapted to be directed toward the interior of the pool. The lower part of the recess 26 receives a fastener strip 28. This strip may be molded directly with the remainder of the wall panel in a manner described below and is adhered to the wall panel in the recess 26 thereof in the manner shown most clearly in FIG. 4. The fastener strip 28 has an upper lip 30 behind which it is possible to situate a thicker bead portion 32 of a vinyl pool-liner sheet 34, so that the liner 34 will be maintained against the inner surface of the panels to line the pool. Of course, the liner 34 is manufactured so as to cover the ground at the bottom of the pool as well as to extend upwardly along the inner circular pool wall surface, being held at its top edge in a manner shown in FIG. 4.

The coping portion 24 is reinforced by a plurality of relatively short substantially triangular reinforcing fins 36, and between these fins 36 there are a plurality of vertically extending reinforcing fins 38 integral with the wall of each panel and projecting outwardly from the outer surface thereof in the manner shown most clearly in FIGS. 2 and 4. At the bottom of each panel, the vertical wall thereof is integrally joined with a rearwardly or outwardly extending lower wall 40 integrally joined with the vertical reinforcing fins 38 at the bottom ends thereof.

The panels 12 are molded in one piece of a suitable plastic, preferably a high impact polystyrene foam, and when they are molded, the bottom edges are integrally molded with fingers which in turn are integrally molded with a fastener strip 28. When the entire panel is removed from the mold, these fingers are broken away so as to achieve in this way a fastener strip 28 which then can be joined to the panel in the manner shown in FIG. 4 and described above.

Figure 6:
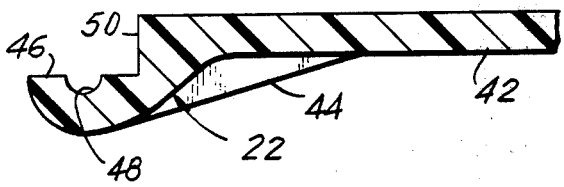
FIG. 6 is a fragmentary partly sectional plan view showing the construction of an outer fastener portion, FIG. 6 being taken along line 6–6 of FIG. 5 in the direction of the arrows.

The inner and outer fastener portions 20 and 22 at each end edge region 18 of each panel are molded integrally with the remainder thereof in a single molded operation together with the remaining panel structure described above. These fastener portions 20 and 22 are shown most clearly in FIGS. 5–7. These fastener portions are substantially rigid and thicker than the remainder of the vertical wall of each panel, as is particularly apparent from FIGS. 6 and 7 which respectively illustrate the outer and inner fastener portions 22 and 20. Thus, the upright panel wall 42 which is fragmentarily illustrated in FIG. 6, and which need have a thickness only on the order of one fourth inch, for example, has outwardly inclined ribs 44 integrally formed with the wall 42 and serving to strengthen the outer fastener portion 22. Each of these outer fastener portions 22 has somewhat outwardly and to the rear of the outer surface of the wall 42 of each panel an inwardly directed surface 46 formed with a vertical semicircular groove 48 in the manner shown most clearly in FIG. 6. Thus the surface 46 is directed toward the interior of the pool and is perpendicular to an end surface portion 50 which with the surface 46 defines a recess for receiving an inner fastener portion 20 of an adjoining end edge region of an adjoining panel as described below.

Figure 7:
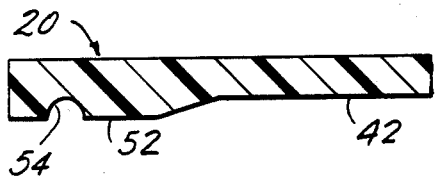
FIG. 7 is a fragmentary partly sectional plan view showing the details of an inner fastener portion, FIG. 7 being taken along line 7–7 of FIG. 5 in the direction of the arrows.

Referring to FIG. 7, the fragmentarily illustrated wall 42 of each panel is made somewhat thicker to provide an inner fastener portion 20, which may have a thickness on the order of three eighths inch, for example. Each inner fastener portion 20 has an outwardly directed surface 52, directed away from the interior of the pool and formed with a vertically extending groove 54 which is semicircular, as shown in FIG. 7.

Figure 5:
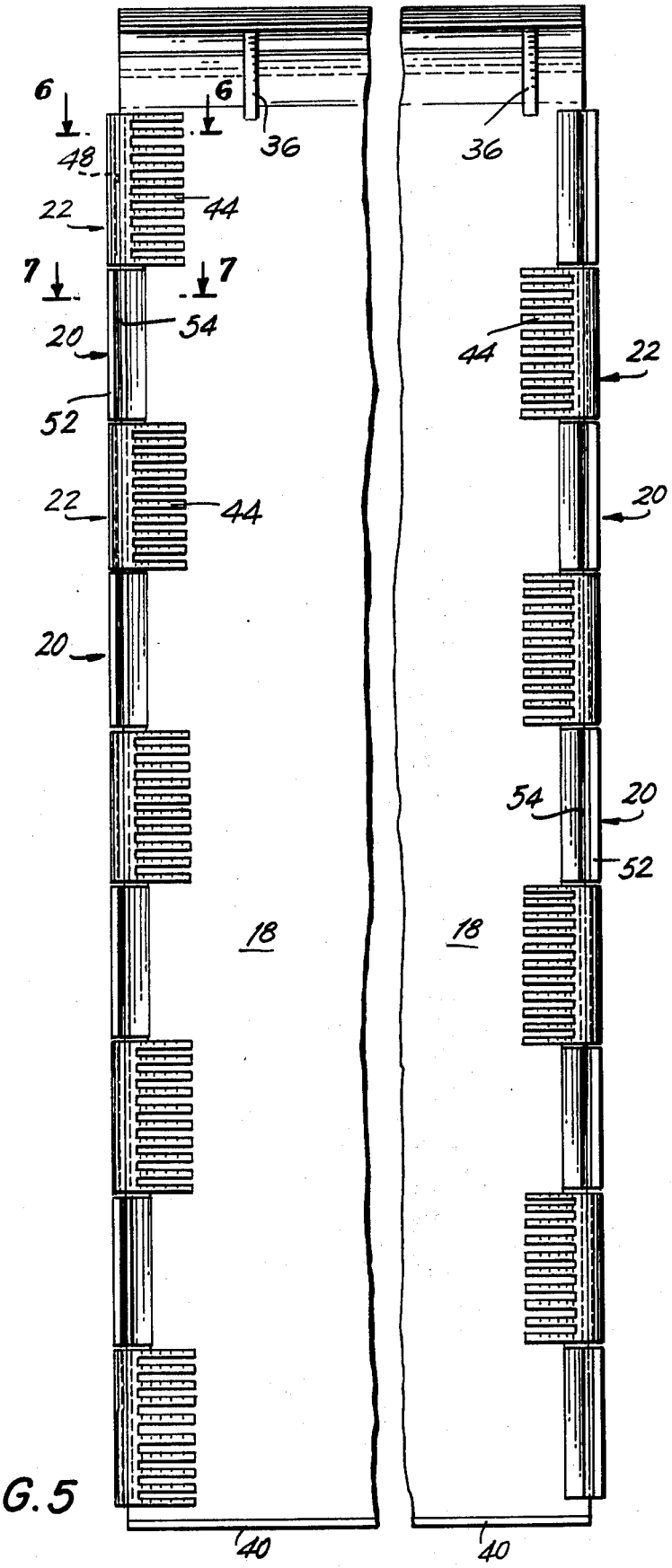
FIG. 5 is a fragmentary elevation of the panel of FIGS. 2–4 as seen when looking toward the outer surface of the panel, FIG. 5 showing in particular the relationship between the opposed end edge regions of the panel.

The manner in which the several fastener portions 20 and 22 are distributed along each end edge region 18 is particularly apparent from FIG. 5. These fastener portions are all of the same height and it will be seen that at each end edge region 18 the inner fastener portions 20 alternate in elevation with the outer fastener portions 22. The grooves 54 are visible in FIG. 5 inasmuch as FIG. 5 shows the panel when looking toward the outer surface thereof. The grooves 48 are of course in alignment with the grooves 54, and above the uppermost fastener portions the opposed end surface of each panel are formed each with a semicircular groove 56 extending downwardly through the end surface of each coping portion 24 and the stepped portion defining the recess 26. Thus, the groove 56 forms a continuation of the aligned grooves of the several fastener portions. As is apparent from FIG. 5, the outer fastener portions 22 at one end edge region 18 of a panel are respectively situated at the same elevation as the inner fastener portions 20 at the opposed end edge region of a panel. As is apparent particularly from FIG. 4, the outwardly directed surfaces 52 of the inner fastener portions 20 and the inwardly directed surfaces 46 of the outer fastener portions 22 are all situated in a substantially common plane which contains the axis of a vertically extending bore of which all of the grooves 48, 54, and 56 form a part.

It will be seen that by reason of this construction a rod 14, the diameter of which corresponds to the radius of each groove 48, 54, or 56, can be inserted into or removed from the grooves at the fastener portions at the end edge region of a panel only by being displaced vertically with respect to an upright panel.

Figure 8:
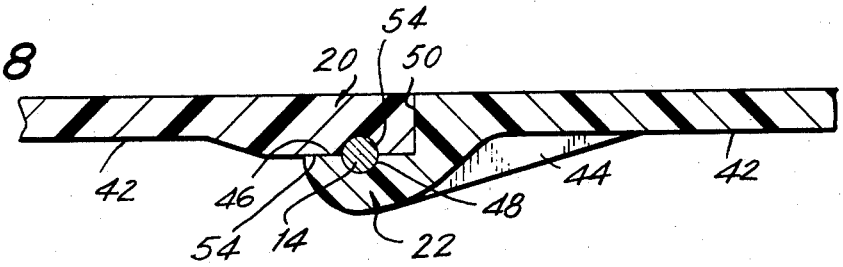
FIG. 8 is a fragmentary sectional plan view showing the cooperation between inner and outer fastener portions at adjoining end edge regions of a pair of adjoining panels.

When the pool is to be set up, a pair of adjoining panels are placed in end-to-end relation with the inner fastener portions 20 at an end edge region of one panel interdigitated between the inner fastener portions 20 of the adjoining panel, and in the same way the outer fastener regions 22 of one panel will be interdigitated with the outer fastener portions 22 of the adjoining panel. In this way the inner and outer fastener portions of adjoining panels will have the relationship indicated in FIG. 8, forming a substantially closed continuous bore for receiving the rod 14, as also illustrated in FIG. 8.

With this construction, the several panels are reliably interlocked by the rods 14 in such a way that they can readily withstand the force of the water in the pool. After the series of panels have been set up in the above manner so as to form a complete circle, the fastener portions 28 can be adhered in the recesses 26 in the manner described above and shown in FIG. 4, and then the liner can be attached, thus completing the pool. A suitable ladder may be provided to give ready access to the pool.

Even though each panel has a wall thickness which is only on the order of one fourth inch, it has been found that with the structure of the invention a highly reliable continuous pool wall is provided made up of relatively simple light-weight panels each of which can be molded in a single molding operation.

As has been pointed out above, it is preferred to make the wall panels of a plastic sheet material molded in a single mold in which the entire wall panel is molded in a single molding operation, together with the fastener strip as described above.

It has been found that high impact polystyrene foam is most suitable for the pool walls of the invention inasmuch as this material has the required strength as well as light-ness of weight. While the interior wall structure is cellular the exterior surfaces of the panels are solid and uninterrupted so that these smooth exterior surfaces can, for example, be painted any desired color presenting a continuous smooth surface while at the same time all of the above advantages are retained for the pool of the invention. The several panels and rods 14 thus form the entire pool wall structure of the invention. The panels 12 can be constructed in the manner disclosed in U.S. Pat. Nos. 3,268,636 or 3,436,446.

What is claimed is:

1. In an above-ground pool, a plurality of upright adjoining wall panels situated in end-to-end relation along a predetermined enless path so that said panels surround a given space in which water for the pool can be situated, an upright rod situated between each pair of adjoining panels, each panel having a pair of opposed end regions and each panel having at each end edge region thereof a plurality of substantially rigid fastener portions distributed along each end edge region of each panel, said fastener portions at each end edge region of each panel including a plurality of inner fastener portions and a plurality of outer fastener portions respectively alternating in elevation with said inner fastener portions, said outer fastener portions respectively having inwardly directed surfaces directed inwardly toward said space and respectively formed with aligned grooves receiving part of a rod and said inner fastener portions respectively having outwardly directed surfaces directed away from said space and respectively formed with aligned grooves also receiving part of said rod, so that said rod can be situated in and removed from said grooves of said fastener portions at each end edge region of each panel only by being moved substantially vertically with respect to an upright panel, and the inner and outer fastener portions at an end region of one panel being situated respectively at the same elevations as outer and inner fastener portions at an adjoining end edge region of the next panel with all of the inner fastener portions at adjoining end edge regions of a pair of adjoining panels being interdigitated and all of the outer fastener portions at adjoining end edge regions of a pair of adjoining panels being interdigitated, so that by way of said rods said plurality of panels are held together to form a pool wall, said panels respectively having inner surfaces directed inwardly toward said space, and all of said inner fastener portions at each end edge region of each panel having inwardly directed surfaces respectively forming continuations of said inner surface of each panel, and the inner fastener portions at an end edge region of one panel being situated respectively between and respectively substantially, filling the gaps between the inner fastener portions at an adjoining end edge region of the next panel with the inwardly directed surfaces of the inner fastener portions of adjoining end edge regions of a pair of successive panels forming a substantially continuous surface which forms a continuation of the inner surfaces of the adjoining panels so that all of said wall panels cooperate to form a substantially continuous inner wall surface for the pool, each wall panel being formed in its entirety of a single body of plastic material so that the entire pool wall consists only of said single bodies of plastic material which respectively form said panels and said rods, each panel having at its fastener portions a thickness greater than at the remainder of each wall panel, said outwardly directed surfaces of said inner portions being situated outwardly beyond an outer surface of each panel extending between said fastener portions thereof at each end region of each panel and said outer fastener portions also having outwardly directed surfaces situated outwardly beyond said outer surface of each panel extending between said fastener portions thereof at each end region of said panel, and said greater thickness of said fastener portions being provided only by the location of said outwardly directed surfaces of all of said fastener portions outwardly beyond said outer surface of each panel so that said inwardly directed surfaces of all of said inner fastener portions do not extend inwardly beyond the remainder of the inner surface of each panel and thus do not alter the continuity of said substantially continuous inner wall surface.

2. The combination of claim 1 and wherein each fastener portion at each end edge region of each panel extends at said groove thereof approximately half way around a rod.

3. The combination of claim 2 and wherein said grooves are of approximately semicircular cross section while said rod is of a circular cross section.

4. The combination of claim 1 and wherein all of said panels are identical, said inner surfaces of said panels being concave and each panel extending along an arc of a circle so that the pool wall forms a pool of circular configuration.

5. The combination of claim 1 and wherein each panel has a relatively small thickness and has a top hollow coping portion and directly beneath the latter a stepped portion defining an inwardly directed recess, an elongated fastener strip being situated in said inwardly directed recess of each panel with said fastener strip being fixedly joined to each panel and having an upper lip behind which it is possible to situate a relatively thick bead portion at the upper end of a pool liner sheet.

6. The combination of claim 1 and wherein each wall panel is made of high impact polystyrene foam.

7. The combination of claim 1 and wherein said outwardly directed surfaces of all of said fastener portions situate said inwardly directed surfaces of said outer fastener portions and said outwardly directed surfaces of said inner fastener portions outwardly beyond said outer surface of each panel, and strengthening ribs integrally formed with each panel at the region of said outer fastener portions thereof and extending between said outwardly directed surfaces of said outer fastener portions and said outer surface of each panel.

8. The combination of claim 7 and wherein said strengthening ribs are respectively situated in planes perpendicular to said grooves.

9. The combination of claim 8 and wherein said ribs are inclined outwardly from said outer surface of each panel up to said outwardly directed surfaces of said outer fastener portions.

10. For use in an above-ground pool, a wall panel consisting of a single body of sheet material having opposed end edge regions adapted to be connected with end edge regions of adjoining wall panels, said wall panel having at each of its end edge regions a series of substantially rigid fastener portions distributed along each end edge region of said panel, said fastener portions including inner fastener portions and outer fastener portions which alternate with said inner fastener portions along each end edge region of said panel, said outer fastener portions respectively having inner surfaces adapted to be directed toward the interior of a pool and respectively formed with aligned grooves while said inner fastener portions have outwardly directed surfaces adapted to be directed away from the interior of a pool and also formed with aligned grooves, all of said grooves being aligned with each other and extending along each end edge region of said panel, and said inwardly directed surfaces of said outer fastener portions as well as said outwardly directed surface of said inner fastener portions all being situated substantially in a common plane, the outer fastener portions at one of said end edge regions of said panel being situated respectively at the same elevations as the inner fastener portions at the other end edge region of said panel, said panel having a relatively small thickness and a top hollow coping portion and directly beneath the latter a stepped portion defining an inwardly directed recess, and an elongated fastener strip situated in said recess and fixedly joined to said panel, said fastener strip having an upper lip behind which it is possible to situate a thick bead portion of a pool liner sheet.

11. A panel as recited in claim 10 and wherein the entire panel is made of a single body of relatively thin plastic sheet material.

12. A wall panel as recited in claim 11 and wherein said plastic sheet material is a high impact polystyrene foam.

13. A panel as recited in claim 10 and wherein said panel has an inner concave surface extending part-way around a given axis and forming part of a circle in a plane normal to said axis.

* * * * *